US005369335A

United States Patent [19]

Lim

[11] Patent Number: 5,369,335

[45] Date of Patent: Nov. 29, 1994

[54] COUPLING DEVICE FOR ANTENNA FEEDER IN A MAGNETRON COMPRISING ENGAGED MALE AND FEMALE MEMBERS

[75] Inventor: Jong H. Lim, Seoul, Rep. of Korea

[73] Assignee: Goldstar Co., Ltd., Seoul, Rep. of Korea

[21] Appl. No.: 990,778

[22] Filed: Dec. 10, 1992

[30] Foreign Application Priority Data

Dec. 13, 1991 [KR] Rep. of Korea ..... 91-22218

[51] Int. Cl.[5] ..... H01J 23/44; H01J 25/50

[52] U.S. Cl. ..... 315/39.53; 315/39.51

[58] Field of Search ..... 315/39.53, 39.51

[56] References Cited

U.S. PATENT DOCUMENTS 3,334,266 8/1967 Frutiger ..... 315/39.53
4,042,851 8/1977 Yasuoka et al. ..... 315/39.77 X
4,459,563 7/1984 Kawaguchi ..... 315/39.53 X
5,089,744 2/1992 Park ..... 315/39.51 X
5,216,327 6/1993 Myers et al. ..... 315/39.53

FOREIGN PATENT DOCUMENTS 167938 9/1984 Japan ..... 315/39.53
262345 11/1987 Japan ..... 315/39.53

*Primary Examiner*—Benny T. Lee
*Attorney, Agent, or Firm*—Morgan & Finnegan

[57] ABSTRACT

This invention relates to a magnetron with a device for coupling an antenna feeder to an evacuation tube. The coupling device comprises a male engaging member formed at an upper end of the antenna feeder and a female engaging member formed at a lower end of the evacuation tube and adapted to fittably receive the male engaging member. The female engaging member comprises a hollow boss and a pair of slits formed at the hollow boss. The coupling device couples the antenna feeder to the evacuation tube before the evacuation tube is tipped off and enables the antenna feeder to be maintained at its initial set position.

2 Claims, 3 Drawing Sheets

COUPLING DEVICE FOR ANTENNA FEEDER IN A MAGNETRON COMPRISING ENGAGED MALE AND FEMALE MEMBERS

BACKGROUND OF THE INVENTION

1. Field of the Invention

The present invention relates to a magnetron for generating radio frequency outputs, and more particularly to a coupling device for an antenna feeder in such a magnetron, capable of preventing the antenna feeder from being shifted upon tipping off the magnetron.

2. Description of the Prior Art

Referring to FIGS. 1 and 2, there is illustrated a general magnetron used for a microwave oven. As shown in FIG. 1, the magnetron comprises a magnetron body 1, a plurality of radially extending vanes 2 disposed in the interior of the magnetron body 1, inner and outer strap members 3 fitted in upper and lower portions of vanes 2 in an alternate manner and arranged to set the desired frequency of the magnetron, and a filament 5 centrally disposed in the magnetron body 1 and adapted to emit thermal electrons (thermions) which are, in turn, radiated into an interaction space 4.

The magnetron also comprises a magnetic pole 6 disposed above the vanes and an antenna feeder 7 disposed at one side of the magnetic pole 6. The antenna feeder 7 has one end fitted in a selected one of vanes 2 and the other end extending through an output-side seal member 8 and an output-side ceramic member 9 for achieving a hermetic sealing and an insulation to an evacuation tube 10 for evacuating gas out of the interior of magnetron body 1.

With the above-mentioned construction, thermal electrons (thermions) from the filament 5 radiated to the inner and outer strap members in the interaction space 4 are affected by an electrical field exerted between the filament 5 and the vanes 2 and a magnetic field exerted vertically in the interaction space 4 by the magnetic pole 6, to do a cycloidal movement. An electromagnetic wave energy is generated by electrons which are accelerated by the cycloidal movement. The electromagnetic wave energy is transferred to one end of each vane 2 disposed toward the filament 5 and then fed along the vane 2 in the form of current.

Thereafter, the electromagnetic energy is discharged outwardly through the antenna feeder 7 engaged with the vane 2.

On the other hand, the interior of magnetron body 1 should be maintained at a vacuum condition. To this end, an evacuation through the evacuation tube 10 is performed after the antenna feeder 7 is coupled to the vane 2. After the evacuation, the evacuation tube 10 is tipped off.

When the evacuation tube 10 is tipped off, however, the antenna feeder 7 made of a wire material is depressed down and tipped off as shown in FIG. 3, because the antenna feeder 7 extends to the evacuation tube 10 as shown in FIG. 2. Furthermore, such a depression causes the antenna feeder 7 to be downwardly shifted from its initial set position. As a result, the antenna feeder 7 is difficult to be maintained in position on the line path of the output side of magnetron, thereby causing its output characteristic to vary greatly. This is because the output of antenna feeder 7 varies when the output-side construction of magnetron does not maintain a uniform dimension at its portion through which the antenna feeder passes.

As the antenna feeder 7 is downwardly shifted, the vane 2 engaged therewith is also deformed, thereby causing imbalance of overall construction of the magnetron. As a result, the conventional magnetron has fatal defects which degrades the output and the associated characteristics.

SUMMARY OF THE INVENTION

Therefore, an object of the invention is to eliminate the above-mentioned disadvantages encountered in the prior art and to provide a coupling device for an antenna feeder in a magnetron, capable of preventing the antenna feeder from being shifted upon tipping off the magnetron.

In accordance with the present invention, this object can be accomplished by providing a magnetron comprising: a magnetron body; an antenna feeder disposed in the magnetron body; an evacuation tube formed at an upper portion of the magnetron body and adapted to evacuate the magnetron body, the evacuation tube being tipped off after the evacuation; and means for coupling the antenna feeder to the evacuation tube, the means including a male engaging member formed at an upper end of the antenna feeder and a female engaging member formed at a lower end of the evacuation tube and adapted to fittably receive the male engaging member.

BRIEF DESCRIPTION OF THE DRAWINGS

Other objects and aspects of the invention will become apparent from the following description of embodiments with reference to the accompanying drawings in which.

DETAILED DESCRIPTION

Figure 1:
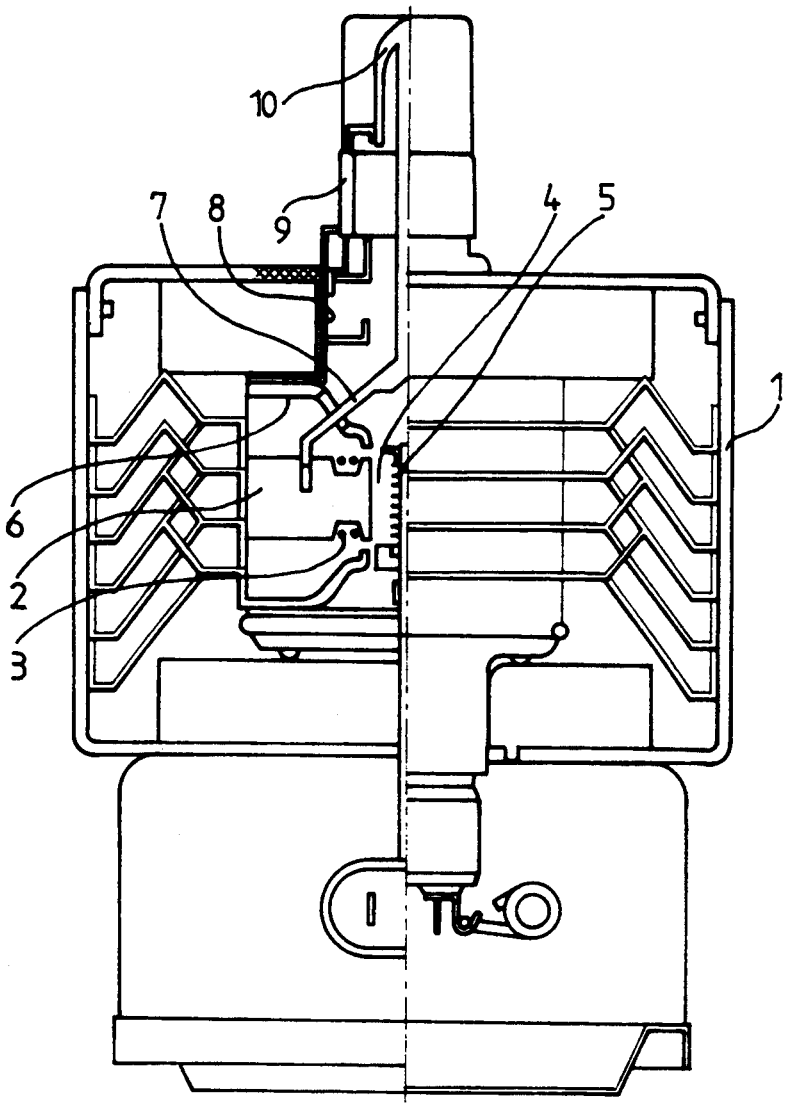
FIG. 1 PRIOR ART
FIG. 1 is a partially sectioned front view of a conventional magnetron.
Figure 2:
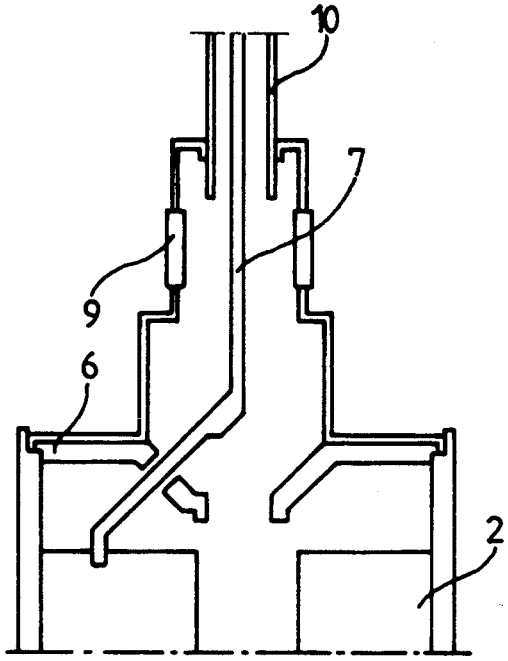
FIG. 2 PRIOR ART
FIG. 2 is a partial sectional view of the conventional magnetron, showing an antenna feeder.
Figure 3:
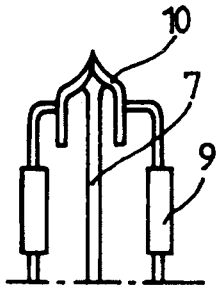
FIG. 3 PRIOR ART
FIG. 3 is a partial sectional view of the conventional magnetron, showing a tipped-off condition.
Figure 4:
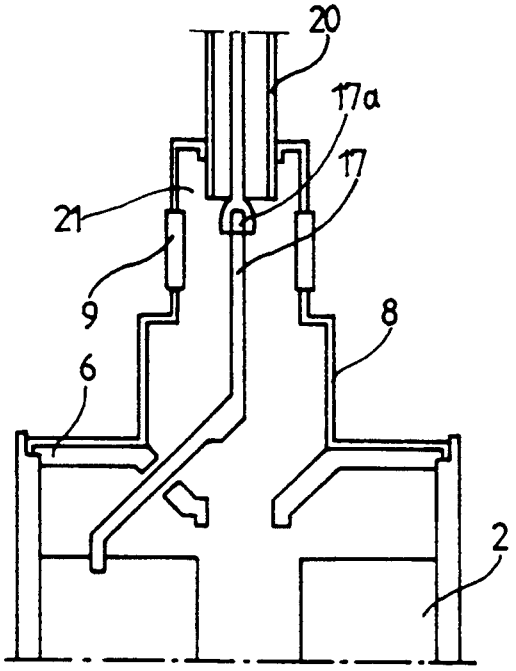
FIG. 4 is a partial sectional view of a magnetron in accordance with the present invention, showing the overall construction of an antenna feeder.
Figure 5:
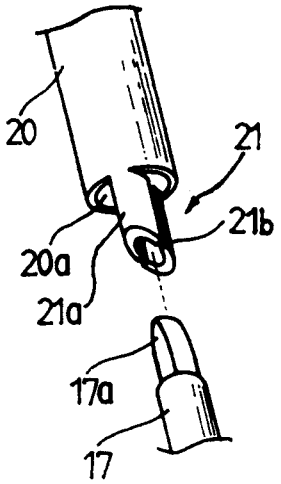
FIG. 5 is an exploded partial perspective view of the magnetron shown in FIG. 4, showing a portion of the antenna feeder.

FIGS. 4 and 5 are a partial sectional view and an exploded partial perspective view illustrating magnetron with a coupling device for an antenna feeder in accordance with the present invention, respectively. In the magnetron shown in FIGS. 4 and 5, the same elements as those shown in FIGS. 1 and 2 are denoted by the same reference numerals and their detailed description will be omitted.

As shown in FIG. 4, the magnetron comprises a magnetron body 1 (not shown), a plurality of radially extending vanes 2 disposed in the interior of the magnetron body 1, a magnetic pole 6 disposed above the vanes 2 and beneath an output-side seal member 8, and an antenna feeder 17 disposed at one side of the magnetic pole 6.

In accordance with the present invention, the antenna feeder 17 has one end fitted in a selected one of vanes 2 and the other end provided with a male engaging member 17*a* having a cross-sectional area smaller than that of the antenna feeder 17.

The male engaging member 17*a* provided at the antenna feeder 17 may have various cross-sectional shape, for example, a cylindrical shape. In a preferred embodiment, it has a polygonal shape, for enhancing a clamping force therefor.

The magnetron also comprises an evacuation tube 20 having at its one end a female engaging member 21 fittably receiving the male engaging member 17*a*.

The female engaging member 21 may have various constructions, provided that a passage 20*a* (see FIG. 5) is formed which serves to communicate the interior of magnetron body 1 with the evacuation tube 20. In a preferred embodiment, the female engaging member 21 comprises a hollow boss 21*a* and a pair of slits 21*b* formed at the hollow boss 21*a* to extend axially of the hollow boss 21*a*, as shown in FIG. 5.

When the male engaging member 17*a* of the antenna feeder 17 is fitted in the female engaging member 21, the hollow boss 21*a* is forcedly widened at its slits 21*b* by the tip of the male engaging member 17*a*, to receive the male engaging member 17*a*. After fitting, the male engaging member 17*a* is securely clamped in the hollow boss 21*a*, by virtue of a resilience force generating at the hollow boss 21*a* by the provision of slits 21*b*.

The effect of the clamping device according to the present invention will be described.

After the antenna feeder 17 passes through the output-side seal member 8 such that one end thereof is fitted in the selected vane 2, the male engaging member 17*a* formed at the other end thereof is fitted in the female engaging member 21 formed at the evacuation tube 20, as shown in FIG. 4. As the male engaging member 17*a* of the antenna feeder 17 is fitted in the female engaging member 21, the hollow boss 21*a* is forcedly widened at its slits 21*b* by the tip of the male engaging member 17*a*, to receive the male engaging member 17*a*. After fitting, the male engaging member 17*a* is securely clamped in the hollow boss 21*a*, by virtue of the resilience force generating at the hollow boss 21*a*. Thus, a coupling is completed between the antenna feeder 17 and the evacuation tube 20.

Figure 6:
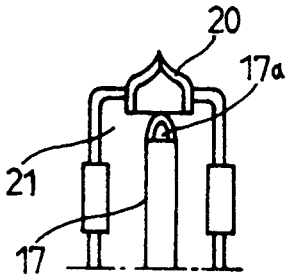
FIG. 6 is a partial sectional view of the magnetron shown in FIG. 4, showing a tipped-off condition.

After coupling the antenna feeder 17 and the evacuation tube 20, an evacuation is carried out through the evacuation tube 20. The evacuation tube 20 is then tipped off, as shown in FIG. 6. When the evacuation tube 20 is tipped off, the antenna feeder 17 is still maintained at its initial set position without any shift, in that it is firmly clamped at the other end thereof in the female engaging member 21 formed at one end, namely, the lower end of the evacuation tube 20.

As apparent from the above description, the present invention provides a magnetron with a coupling device for an antenna feeder of a simple construction comprising a male engaging member formed at the antenna feeder and a female engaging member formed at an evacuation tube and adapted to clamp the male engaging member. With this coupling device, the evacuation tube can be tipped off under the condition that the antenna feeder is maintained at its initial set position. Accordingly, it is possible to provide a uniform output characteristic of the magnetron and thus to improve the quality of magnetron.

Although the preferred embodiments of the invention have been disclosed for illustrative purpose, those skilled in the art will appreciate that various modifications, additions and substitutions are possible, without departing from the scope and spirit of the invention as disclosed in the accompanying claims.

What is claimed is:

1. A magnetron comprising:

a magnetron body having an upper portion;

an antenna feeder having an upper end and disposed in the magnetron body;

an evacuation tube having a lower end, said lower end is located at the upper portion of the magnetron body; and means for coupling the antenna feeder to the evacuation tube, the means including a male engaging member connected to the upper end of the antenna feeder and a female engaging member connected to the lower end of the evacuation tube and receiving the male engaging member therein, and the female engaging member including a hollow boss and at least one slit in the hollow boss.

2. A magnetron in accordance with claim 1, wherein the slit extends along a lengthwise direction of the hollow boss.

* * * * *